US008215289B2

(12) United States Patent
Fischer et al.

(10) Patent No.: US 8,215,289 B2
(45) Date of Patent: Jul. 10, 2012

(54) FUEL-INJECTION DEVICE

(75) Inventors: Michael Fischer, Niefern-Oeschelbronn (DE); Peter Lang, Weissach (DE); Hauke Roesch, Grosskarlbach (DE)

(73) Assignee: Robert Bosch GmbH, Stuttgart (DE)

( * ) Notice: Subject to any disclaimer, the term of this patent is extended or adjusted under 35 U.S.C. 154(b) by 310 days.

(21) Appl. No.: 12/592,809

(22) Filed: Dec. 2, 2009

(65) Prior Publication Data

US 2010/0154746 A1 Jun. 24, 2010

(30) Foreign Application Priority Data

Dec. 22, 2008 (DE) ..... 10 2008 055 105

(51) Int. Cl.
*F02M 61/14* (2006.01)

(52) U.S. Cl. ..... 123/470

(58) Field of Classification Search ..... 123/468, 123/469, 470, 456
See application file for complete search history.

(56) References Cited

U.S. PATENT DOCUMENTS

| | | | | | |
|---|---|---|---|---|---|
| 4,142,769 | A * | 3/1979 | Wood | 439/271 |
| 4,307,693 | A | 12/1981 | Glöckler et al. | |
| 5,016,594 | A * | 5/1991 | Hafner et al. | 123/470 |
| 5,121,731 | A * | 6/1992 | Jones | 123/470 |
| 5,226,391 | A * | 7/1993 | Gras et al. | 123/456 |
| 5,299,542 | A * | 4/1994 | Hafner | 123/470 |
| 5,323,749 | A * | 6/1994 | Gras et al. | 123/470 |
| 5,479,900 | A * | 1/1996 | Bodenhausen et al. | 123/470 |
| 5,551,400 | A * | 9/1996 | Rice et al. | 123/470 |
| 5,724,946 | A * | 3/1998 | Franchitto | 123/470 |
| 6,422,205 | B2 * | 7/2002 | Wynn et al. | 123/457 |
| 6,491,026 | B1 * | 12/2002 | Andorfer | 123/470 |
| 6,705,292 | B2 * | 3/2004 | Bugos | 123/470 |
| 6,830,035 | B2 * | 12/2004 | Nishiwaki et al. | 123/470 |
| 7,107,969 | B2 * | 9/2006 | Norcutt et al. | 123/470 |
| 7,398,767 | B2 * | 7/2008 | Kondo et al. | 123/470 |
| 7,438,055 | B1 * | 10/2008 | Xu et al. | 123/470 |
| 2009/0056674 | A1 | 3/2009 | Furst et al. | |

FOREIGN PATENT DOCUMENTS

| | | |
|---|---|---|
| DE | 29 26 490 | 2/1981 |
| DE | 43 29 774 | 3/1995 |
| DE | 101 08 193 | 8/2002 |
| DE | 10 2004 048 401 | 4/2006 |
| EP | 0 386 444 | 9/1990 |

* cited by examiner

*Primary Examiner* — Thomas Moulis
(74) *Attorney, Agent, or Firm* — Kenyon & Kenyon LLP

(57) ABSTRACT

A fuel-injection device includes at least one fuel injector, one receiving bore-hole for the fuel injector, and one pipe-shaped pipe connection of a fuel rail. The fuel injector is pushed into the interior of the pipe connection by an upstream inlet connection. A bayonet closure ensures that the fuel injector is fastened in the pipe connection of the fuel rail in a secure and detachable manner.

15 Claims, 3 Drawing Sheets

FUEL-INJECTION DEVICE

BACKGROUND OF THE INVENTION

1. Field of the Invention

The present invention relates to a fuel-injection device, and relates more particularly to mounting of the fuel-injection device.

2. Description of Related Art

A mounting device for mounting a fuel injector on an intake manifold is already known from German patent document DE 29 26 490 A1, according to which a mounting element axially fixes the fuel injector to the fuel rail or to a plug nipple, the mounting element being designed as a U-shaped securing clasp having two legs which are elastic in the radial direction. In the assembled state, the securing clasp engages in matching recesses of the plug nipple and is snapped into place in a recess in a connection piece of the fuel injector, the recess being designed as an annular groove. The axial clearance between the recesses and the securing clasp as well as between the annular groove and the securing clasp should be kept small, in order to achieve accurate fixation of the fuel injector without stresses on the gasket.

Particularly disadvantageous in the mounting device known from German patent document DE 29 26 490 A1 is the warping effect of the various mounting elements on the fuel injector. The flux of force generated in the fuel injector results in deformations and thus in lift changes of the valve needle and even in jamming, as well as in a compressive or bending load on the housing components, which usually have thin walls and are welded to one another at several points. Furthermore, any mounting measure, for example by a contact flange, leads to an increase in the radial expansion of the fuel injector and thus to higher space requirements in the installation.

A mounting device is already known from published German patent document DE 101 08 193 A1 for the two-way fastening of a fuel injector in a cylinder head of an internal combustion engine and of the fuel injector to a fuel rail. The mounting device includes a sleeve which is held between a shoulder of the fuel rail and a shoulder of the fuel injector, and is developed of an elastic material. In view of its tube-shaped structure, the sleeve is able to transfer the holding-down forces in an only conditionally effective manner to the fuel injector. The areas of the sleeve used as holding-down element, that are stressed by the shoulders of the fuel injector and the fuel rail, represent the cutting edges created during production of the blank of the sleeve conditioned by production.

One known design approach of a fuel-injection device, having a (high-pressure) fuel injector that is plugged into a connection piece of a fuel rail, and inserted into a receiving borehole of a cylinder head, in a so-called top feed construction, as well as having a known holding-down element, is described in published German patent document DE 10 2004 048 401 A1, to which reference will be made later in the description, in light of FIG. 1, for the better understanding of the present invention.

In addition, in the case of so-called bottom feed or side feed fuel injectors, other mounting possibilities of contact elements on fuel injectors are known. An electrically operated fuel injector valve is known from published European patent document EP 0 386 444 B1, which is able to be fastened by rotation about its longitudinal valve axis on a fuel distributor using a bayonet-type closure. The first electric contact elements of the fuel injector, that project from the valve housing parallel to the valve axis, are electrically contacted by second electrical contact elements which are situated on a contacting connector that is able to be placed onto the fuel rail in the direction of the valve's longitudinal axis.

The contacting connector that is able to be placed onto the fuel distributor is provided with threaded bores or spacer sleeves, in order to assure the fastening onto the fuel injector. The bayonet closure provided for fastening the fuel injector is developed with its bayonet locking bar directly on the fuel injector, and is in connection with recesses of the bayonet closure on the fuel distributor. This being the case, only fuel injectors are able to be inserted in the fuel distributor which have elements of the bayonet closure.

A fuel-injection device is known from published German patent document DE 43 29 774 A1, in which the side feed fuel injector has no functional elements for mounting in the valve seat of the fuel distributor. Instead, a rotatable holding-down clamp is used, which prevents the slipping of the fuel injector using an inner pressure element, and, using an outer fastening ring as a part of a bayonet closure, whose corresponding bayonet locking bars are developed on the fuel rail, for a simple and secure fastening on the fuel distributor.

The two abovementioned known design approaches, in this instance, have fuel distributors as large-volume fuel supply devices which take up and enclose the fuel injectors almost completely. The side feed fuel injectors, in this instance, have fuel flowing about them over a large surface and are supplied from the side with fuel. These construction types are suitable exclusively for intake manifold injection, but not for direct injection in which the fuel injectors are inserted directly into the receiving boreholes of the cylinder head.

BRIEF SUMMARY OF THE INVENTION

The fuel-injection device according to the present invention has the advantages of a simple design, simple and cost-effective production, and facilitates a very secure and effective fixing of the fuel injector in a receiving borehole of a cylinder head. The mounting of the fuel injector on the fuel rail, according to the present invention, has, above all, the advantage that hydraulic forces are transferred directly to the fuel rail. The installation of the fuel rail-fuel injector composite may advantageously take place in that the fuel injector does not axially touch the cylinder head at any place, so that structure-borne noise bridges are avoided that cause or reinforce noises.

It is also advantageous that the connection of (top-feed) fuel injector and fuel rail may be detached again in a simple and elegant manner. This may clearly simplify the exchange, for instance, of defective fuel injectors. Other valve types having bayonet closures may also be used without a problem because of the easy exchangeability.

The bayonet closure may advantageously be designed in such a way that, at the pipe connection of the fuel rail, either bayonet locking bars are shaped radially inwards or radially outwards which, in each case, correspond to the bayonet locking bars of the fuel injectors directed in the opposite direction, for bayonet closure.

Because of the shaping of crowned, that is, concavely or convexly arched bayonet locking bars, a tolerance-conditioned placement at an angle of the fuel injector may be adjusted for in optimal fashion, without an endangering bending stress of same.

For sealing the fuel injector from the pipe connection, it is advantageous to use a known, usual sealing ring, for instance, in the form of an O-ring, the sealing ring being able to be put under a specified stress in such a way that it acts itself as a holding-down clamp, while one may do without a pressure spring.

DETAILED DESCRIPTION OF THE INVENTION

Figure 1:
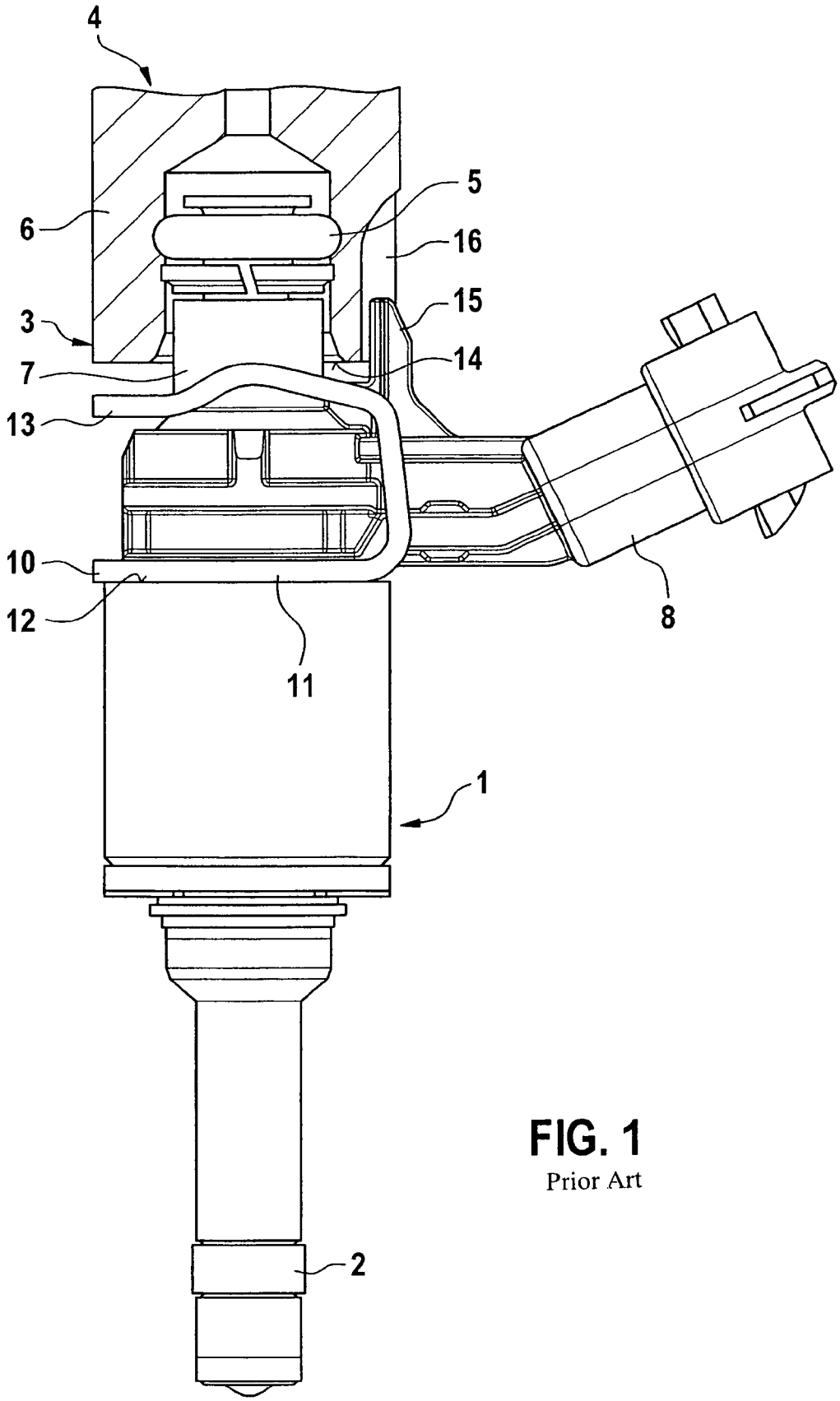
FIG. 1 Prior Art
FIG. 1 shows a conventional fuel-injection device having a top feed fuel injector for the direct injection of fuel into a combustion chamber.

FIG. 1 shows a conventional example of a fuel injector, in which a valve is shown in a side view in the form of a fuel injector 1 for fuel-injection systems of mixture-compressing internal combustion engines having externally supplied ignition. Fuel injector 1 is executed as a so-called top feed injection valve, and is thereby a part of a fuel-injection device. At its downstream end, fuel injector 1, which is embodied as a directly injecting fuel injector for the direct injection of fuel into a combustion chamber of the internal combustion engine, is installed in a receiving bore of a non-depicted cylinder head. A sealing ring 2, in particular made of Teflon®, provides optimal sealing between fuel injector 1 from the wall of the cylinder head.

At its intake end 3, fuel injector 1 has a plug connection to a fuel rail 4, which is sealed by a sealing ring 5 between a pipe connection 6 of fuel rail 4, shown in cross section, and an inlet connection 7 of fuel injector 1. Fuel injector 1 has an electrical connecting plug 8 for the electrical contacting so to actuate fuel injector 1.

A holding-down clamp 10 is provided between fuel injector 1 and pipe connection 6 in order to distance fuel injector 1 and fuel rail 4 from each other free from radial force and in order to hold down fuel injector 1 securely in the receiving bore of the cylinder head. Holding-down clamp 10 is designed as a bracket-shaped component, e.g., as a stamped bending part. Holding-down clamp 10 has a partially ring-shaped base element 11, which is supported on a shoulder 12 of fuel injector 1. Using an axially elastic holding-down bracket 13, bent away from the direction of level base element 11, holding-down clamp 10 lies against a downstream end face 14 of pipe connection 6 at fuel rail 4, in the inserted state. In the vicinity of electrical connecting plug 8, holding-down clamp 10 is interrupted.

In the transitional region from electrical connecting plug 8 to fuel injector 1, at least partially in the vicinity of the plastic extrusion coating enveloping inlet connection 7, a pin-shaped projecting peg 15 is provided on fuel injector 1, which corresponds to a groove-like indentation or recess 16 on pipe connection 6 of fuel rail 4. Peg 15 of fuel injector 1, that projects into recess 16, ensures a direct, and with that, a very reliable antirotational protection of fuel injector 1 with respect to fuel rail 4 and ensures the assignment of the rotational position of holding-down clamp 10 to fuel injector 1.

Figure 2:
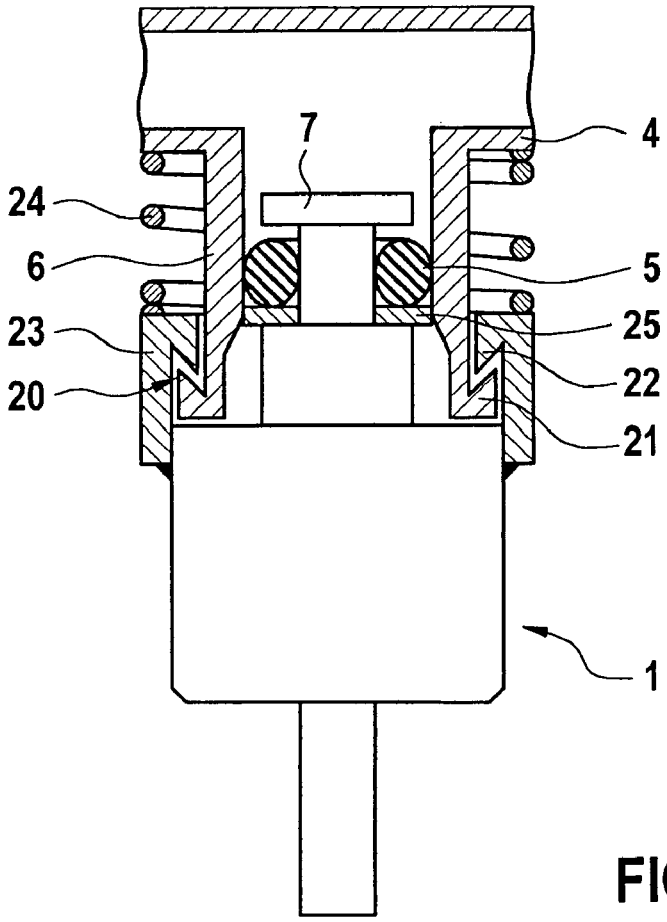
FIG. 2 shows a schematic illustration of a first example embodiment of a fuel-injection device according to the present invention.

FIG. 2 shows a first fuel injector according to the present invention, in schematic representation. The fuel injector device according to the present invention is distinguished by having a bayonet closure 20 provided for it, using which, fuel injector 1, which is introduced by its inlet-side inlet connection 7 into pipe connection 6 of fuel rail 4, is fastened securely, but still, detachably to fuel rail 4. Bayonet closure 20 is developed at the outer circumference of pipe connection 6, in this instance. At its lower end, pipe-shaped pipe connection 6 has bayonet locking bars 21 directed radially outwards, which correspond to bayonet locking bars 22 shaped on fuel injector 1. Bayonet locking bars 22, for instance, are not provided directly on the nozzle body, on the valve housing or on an outer plastic extrusion coating of fuel injector 1, but on a closure part 23 fastened on the outer circumference, that is fastened to fuel injector 1, for instance, by welding, soldering or adhesion. Largely cylindrical closure part 23 has bayonet locking bars 22 which project radially inwards and which interconnect with bayonet locking bars 21 of pipe connection 6 to form bayonet closure 20. Bayonet locking bars 21, 22 are, for example, chamfered in opposite directions or shaped spherically indented, and engage in this manner one behind the other, in the secured state. Because of the shaping of bayonet locking bars 21, 22 using chamfers or spherical indentations (convex/concave), an inclination of fuel injector 1 may be easily adjusted. Alternatively, bayonet locking bars 22 of fuel injector 1 may be integrated directly on a valve part such as a magnetic cup.

Figure 3:
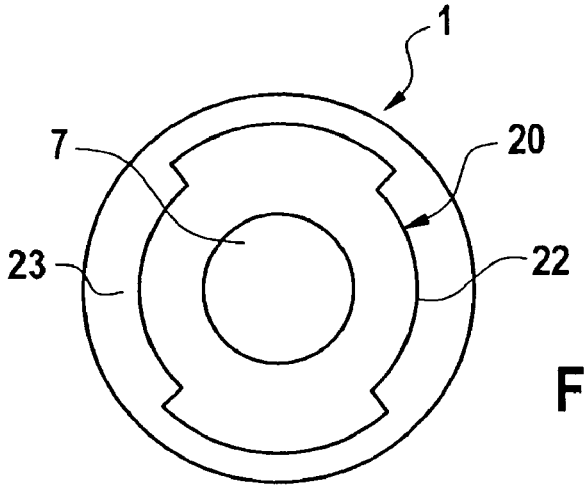
FIG. 3 shows the design of the fuel injector in the area of the bayonet closure according to FIG. 2.

The sealing of fuel injector 1 from pipe connection 6 takes place in a known manner using a sealing ring 5 resting on a support ring 25. As a prestressing element for holding it down, a pressure spring 24, in the form of a spiral spring, may be inserted over pipe connection 6, which is then supported by fuel rail 4 on one side and closure part 23 on the other side A pressure spring 24 may also be positioned on the inside of pipe connection 6. By a specific design of sealing ring 5, it is also possible to use it directly as a prestressing element. FIG. 3 shows the basic design of fuel injector 1 in a top view, in which the region of bayonet closure 20 according to FIG. 2 becomes clear.

Figure 4:
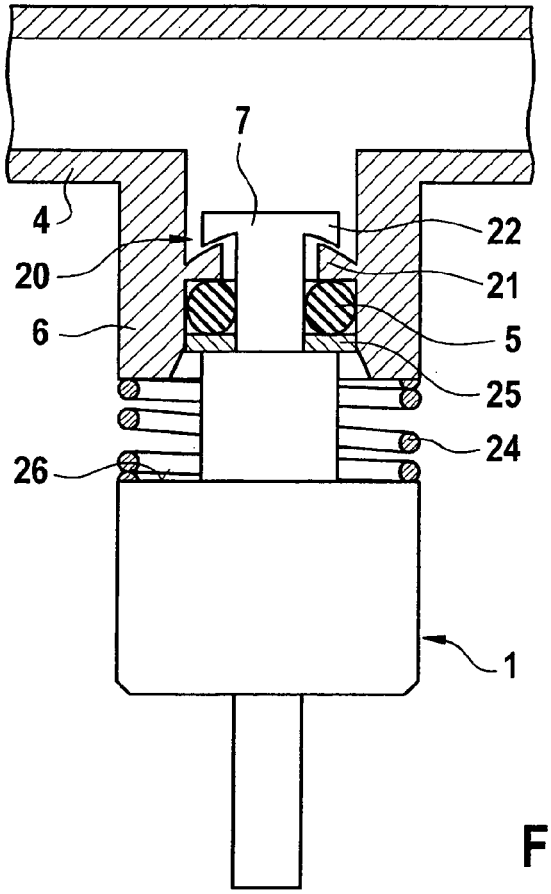
FIG. 4 shows a schematic illustration of a second example embodiment of a fuel-injection device according to the present invention.

FIG. 4 shows a second example embodiment of a fuel injector device according to the present invention, in schematic representation. The fuel injector device according to the present invention is distinguished by having a bayonet closure 20 provided for it, using which, fuel injector 1, which is introduced by its inlet-side inlet connection 7 into pipe connection 6 of fuel rail 4, is fastened securely, but still, detachably to fuel rail 4. Bayonet closure 20 is developed at the inner circumference of pipe connection 6, in this instance. At its inner wall, pipe-shaped pipe connection 6 has bayonet locking bars 21 directed radially inwards, which correspond to bayonet locking bars 22 shaped on fuel injector 1. Inlet connection 7 of fuel injector 1 has bayonet locking bars 22 at its end facing fuel rail 4, which project radially outwards and which interconnect with bayonet locking bars 21 of pipe connection 6 to form bayonet closure 20. Bayonet locking bars 21, 22 are, for example, chamfered or shaped spherically indented in opposite directions (FIG. 4), and engage in this manner one behind the other, in the secured state. Because of the shaping of bayonet locking bars 21, 22 using chamfers or spherical indentations (convex/concave), an inclination of fuel injector 1 may be easily adjusted.

Figure 5:
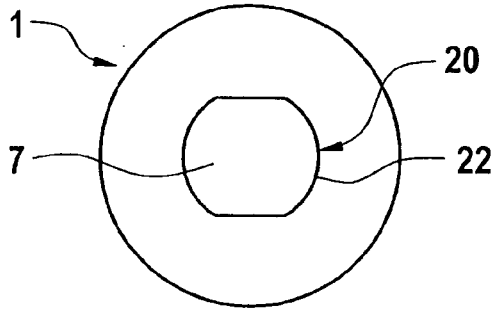
FIG. 5 shows the design of the fuel injector in the area of the bayonet closure according to FIG. 4.

The sealing of fuel injector 1 from pipe connection 6 takes place in a known manner using a sealing ring 5 resting on a support ring 25. As a prestressing element for holding it down, a pressure spring 24 in the form of a spiral spring may be clamped in between downstream end face 14 of pipe connection 6 on fuel rail 4 and a shoulder 26 of the valve housing on fuel injector 1, similarly to holding-down clamp 10 shown in FIG. 1. FIG. 5 shows the basic design of fuel injector 1 in a top view, in which the region of bayonet closure 20, according to FIG. 4, becomes clear.

Figure 6:
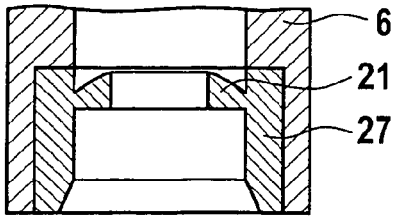
FIG. 6 shows an alternative design in the area of the bayonet closure according the fuel-injection device shown in FIG. 4.

FIG. 6 shows an alternative embodiment of the fuel injector device shown in FIG. 4, in the region of bayonet closure 20. In order to simplify the production and the assembly of the fuel injector device, pipe connection 6 of fuel rail 4 may have a stepped inner accommodation opening. A separately shaped bayonet insert 27, for example, having bayonet locking bars 21 directed inwards, is pushed into the accommodation opening of pipe connection 6, and is securely fastened there, for instance, by soldering. This becomes advantageous especially if fuel rail 4 is developed as a soldered construction. In such a design, it is also possible to develop sealing ring 5 as the holding-down spring, and thus be able to omit pressure spring 24. To do this, sealing ring 5 is put under a specified prestressing between bayonet closure 20 and support ring 25 during assembly.

What is claimed is:

1. A fuel-injection device, comprising:

at least one fuel injector having first bayonet locking bars affixed to an end cap of an inlet-side connection;

one receiving bore-hole for the fuel injector; and one pipe-shaped pipe connection of a fuel rail having second bayonet locking bars, wherein the inlet-side connection of the at least one fuel injector is insertable into the interior of the pipe connection by an upstream inlet connection, wherein the fuel injector is fastened in the pipe connection of the fuel rail by the first and second bayonet locking bars.

2. The fuel-injection device as recited in claim 1, wherein the bayonet locking bars are selectively detachable.

3. The fuel-injection device as recited in claim 2, wherein the first bayonet locking bars are provided on the outer circumference of the pipe connection and directed radially outwards; and the second bayonet locking bars are provided on the fuel injector.

4. The fuel-injection device as recited in claim 3, wherein the second bayonet locking bars of the fuel injector project radially inwards and interconnect with the first bayonet locking bars of the pipe connection to form a bayonet closure.

5. The fuel-injection device as recited in claim 4, wherein the second bayonet locking bars are provided on the fuel injector on one of a valve component part or a closure part fastened to the outer circumference of the fuel injector.

6. The fuel-injection device as recited in claim 2, wherein the first bayonet locking bars are provided on the inner wall of the pipe connection and directed radially inwards; and the second bayonet locking bars are provided on the fuel injector.

7. The fuel-injection device as recited in claim 6, wherein the second bayonet locking bars are provided on an inlet connection of the fuel injector and project radially outwards and interconnect with the first bayonet locking bars of the pipe connection to form a bayonet closure.

8. The fuel-injection device as recited in claim 7, wherein a separate bayonet insert having the first bayonet locking bars directed radially inwards is inserted into an opening of the pipe connection and fastened to the interior of the pipe connection.

9. The fuel-injection device as recited in claim 3, wherein the first and second bayonet locking bars are shaped one of chamfered or spherically indented, and wherein the first and second bayonet locking bars are oriented complementarily to engage one another in the secured state.

10. The fuel-injection device as recited in claim 3, further comprising:

a pressure spring provided between the fuel rail and the fuel injector, wherein the pressure spring acts as a prestressing element for the fuel injector.

11. The fuel-injection device as recited in claim 3, further comprising:

a sealing ring configured to provide sealing of the fuel injector from the pipe connection, wherein the sealing ring is put under a specified stress to function as a holding-down spring.

12. The fuel-injection device as recited in claim 6, wherein the first and second bayonet locking bars are shaped one of chamfered or spherically indented, and wherein the first and second bayonet locking bars are oriented complementarily to engage one another in the secured state.

13. The fuel-injection device as recited in claim 6, further comprising:

a pressure spring provided between the fuel rail and the fuel injector, wherein the pressure spring acts as a prestressing element for the fuel injector.

14. The fuel-injection device as recited in claim 6, further comprising:

a sealing ring configured to provide sealing of the fuel injector from the pipe connection, wherein the sealing ring is put under a specified stress to function as a holding-down spring.

15. The fuel-injection device as recited in claim 1, wherein the at least one fuel injector axially touches neither the receiving bore-hole nor the pipe-shaped pipe connection.

* * * * *